US007487611B2

(12) United States Patent
Robb

(10) Patent No.: US 7,487,611 B2
(45) Date of Patent: Feb. 10, 2009

(54) TWO-PART FLUID RESISTANT INFORMATION DISPLAY SYSTEM

(75) Inventor: Terrance R. Robb, Nanaimo (CA)

(73) Assignee: Kost Klip Manufacturing Inc., British Columbia (CA)

( * ) Notice: Subject to any disclaimer, the term of this patent is extended or adjusted under 35 U.S.C. 154(b) by 198 days.

(21) Appl. No.: 11/625,106

(22) Filed: Jan. 19, 2007

(65) Prior Publication Data

US 2007/0209265 A1 Sep. 13, 2007

(51) Int. Cl.
*G09F 3/18* (2006.01)

(52) U.S. Cl. ..... 40/658; 40/661

(58) Field of Classification Search ..... 40/658, 40/661, 775, 776, 648, 642.02; 211/89.01
See application file for complete search history.

(56) References Cited

U.S. PATENT DOCUMENTS 2,530,821 A * 11/1950 Hubbell ..... 40/658
2,592,386 A * 4/1952 Breakey ..... 40/658
4,292,749 A * 10/1981 Thomas ..... 40/308
4,557,064 A 12/1985 Thompson
4,821,437 A * 4/1989 Abramson et al. ..... 40/658
5,148,618 A 9/1992 Brewster
5,467,949 A * 11/1995 Lemke ..... 248/95
5,799,427 A * 9/1998 Abramson et al. ..... 40/642.02
6,821,018 B1 11/2004 Denko

OTHER PUBLICATIONS

Label Holder solves problems in wash down areas. Trion Industries, Inc. Press Release Dec. 23, 2002. http://news.thomasnet.com.
Eye-Catcher Innovations, Hilton, South Australia, copyright 2005. http://www.eye-catcher.com.au.

* cited by examiner

*Primary Examiner*—Cassandra Davis
(74) *Attorney, Agent, or Firm*—Oyen Wiggs Green & Mutala LLP

(57) ABSTRACT

A two-part fluid resistant information display system for multiple uses such as merchandising is disclosed. The display system combines a first removably mountable part, partially impermeable pocket that cooperates sealingly with a second part shelf mountable clip assembly. The pocket is defined between a first and a second flat panel sealed on their sides. One pocket panel opening edge has an inwardly protruded channel being pressed against the second flat panel to provide sealing. Pressure is exerted by a projection provided in the clip assembly. The clip assembly further comprises an upper flexible hinge that is hingingly joined to a mounting panel that can be mounted to multiple surfaces such as lips of a C-channel of a merchandising shelf, vertical and horizontal surfaces using fasteners such as magnetic, mechanical or chemical fasteners. The inexpensively produced information display system provides fluid resistance against contaminants coming from all directions.

14 Claims, 5 Drawing Sheets

TWO-PART FLUID RESISTANT INFORMATION DISPLAY SYSTEM

FIELD OF INVENTION

The present invention relates to a two-part fluid resistant information display system. More particularly, the invention relates to a removable, partially impermeable information pocket which opening when inserted into a clip assembly becomes fluid resistant, preventing moisture and other contaminants coming from any and all directions to infiltrate or settle into the information pocket. The fluid resistant information display system of the invention used primarily for merchandising purposes like a label holder may be used to numerous other applications.

BACKGROUND OF THE INVENTION

Typically, label holders for merchandising displays are extensively used in e.g. supermarkets, department stores, warehouses and similar places where different kinds of goods are displayed or stored. Merchandising displays include generally a support surface for permitting label holders to be secured thereto. Known label holder support surfaces include a C-channel, a wire bar or rod, a planar surface for receiving an adhesively-backed label holder, etc. Label holders typically include a mounting portion for engaging with the label holder support mechanism, and a display portion for supporting a merchandising label. A merchandising label may then be placed into, repositioned, modified, or removed from the label pocket.

Label holders are also displayed in moist and humid environments like in produce sections for fruits and vegetables, in meat departments, or floral sections are constantly exposed to water spray from all directions, to body fluids in case of meats or to washdowns, while frozen foods are exposed to condensation. These harsh conditions damage labels and tickets that often tear during replacement or cause ink to run off which in turn requires more replacement caused by above conditions. Additionally, saturation and bleeding affect visual appearances of labels. Therefore, there is a need for a label holder or in a more general term, an information display system that is resistant to fluid infiltration and functional enough so as to be able to receive and display readily labels or tickets in an effective manner, to modify or remove it rapidly, to reposition it and have it sealed again instantly against fluid infiltration, with all the above conditions being met inexpensively.

Faced with all above obstacles, no prior art has disclosed an integrated solution to above challenges. Brewster, of U.S. Pat. No. 5,148,618, discloses an expensively made tamper proof sealed tag requiring alignment pins to align a display window with seals around a frame having mounting holes. Multiple prior art disclose solutions addressing the problem of dust that needs to roll off an upper edge of a label holder but fail to address the problems associated with liquids such as disclosed by Thompson in U.S. Pat. No. 4,557,064. Furthermore, a number of waterproof pockets, envelopes and containers have also been disclosed having sealing means but none disclosed for merchandising purposes. For example, Denko, in U.S. Pat. No. 6,821,018 B1, discloses an expensively made flexible container such as an envelope having a sealable closure, namely for bathers.

A press release posted by Trion Industries Inc. on the internet and dated Jan. 2, 2003 entitled "Label Holder solves problems in wash down areas" describes that the "Model B30 Bottom Load Label Holder eliminates saturation and bleeding of labels caused by washdown solutions entering through open top of top-load label holders. One-piece, sealed-at-the-top design shields labels from water, cleaning fluids, and dirt."

While the above B30 Model provides a partial solution for small labels that fit into C-channels, it suffers from disadvantages associated with the difficulty of protecting labels from water, fluids or other contaminants when being sprayed from all sides of the label holder and the reliability of such sealing when accomplished.

A range of water resistant, all weather sign holder has been also released by Eye-Catcher Innovations of Hilton, South Australia. The water-resistant cover protects paper signs against outdoor and indoor environments. The Eye-Catcher Sign Holder is a Copyright© 2005 of Eye-Catcher Innovations. It discloses this bulky, expensively manufactured product is made of a front structure that folds sealingly over a back structure for encasing a paper sign. It is provided with a metallic support. This bulky, self-standing, expensive sign holder does not attach to shelving and nor does it apply to inexpensively made sign holders in mass merchandising environments.

SUMMARY OF THE INVENTION

This invention relates to a two-part fluid resistant information display system such as for labels and tickets that provides resistance to infiltration against fluids, dust and other contaminants. The present two-part information display system provides a first part partially impermeable information pocket that has a recessed channel on one side of its opening panels. The second part is comprised of a clip assembly that has a projection on a constricted portion of the clip assembly. When the information pocket is inserted in and positioned to lock into the recessed channel of the pocket, the pocket becomes sealed against infiltration from fluids, environmental and chemical contaminants.

Furthermore, the invention provides a display information system that is versatile beyond merchandising applications, is inexpensively produced, is reusable, is aesthetically pleasant, is fluid resistant from any and all directions and provides a system approach rather than a one-part solution. The display system of the invention may be used in grocery stores, market places, hardware stores, outside displays, floral stores and nurseries, meat stores, factories or anywhere where moisture, fluids or contaminants can affect exposed information labels.

BRIEF DESCRIPTION OF THE DRAWINGS

The invention may take form in various components and arrangements of components, and in various steps and arrangements of steps. The drawings are only for purposes of illustrating preferred embodiments of the present invention and are not to be construed as limiting same.

BRIEF SUMMARY OF THE INVENTION

Figure 1:
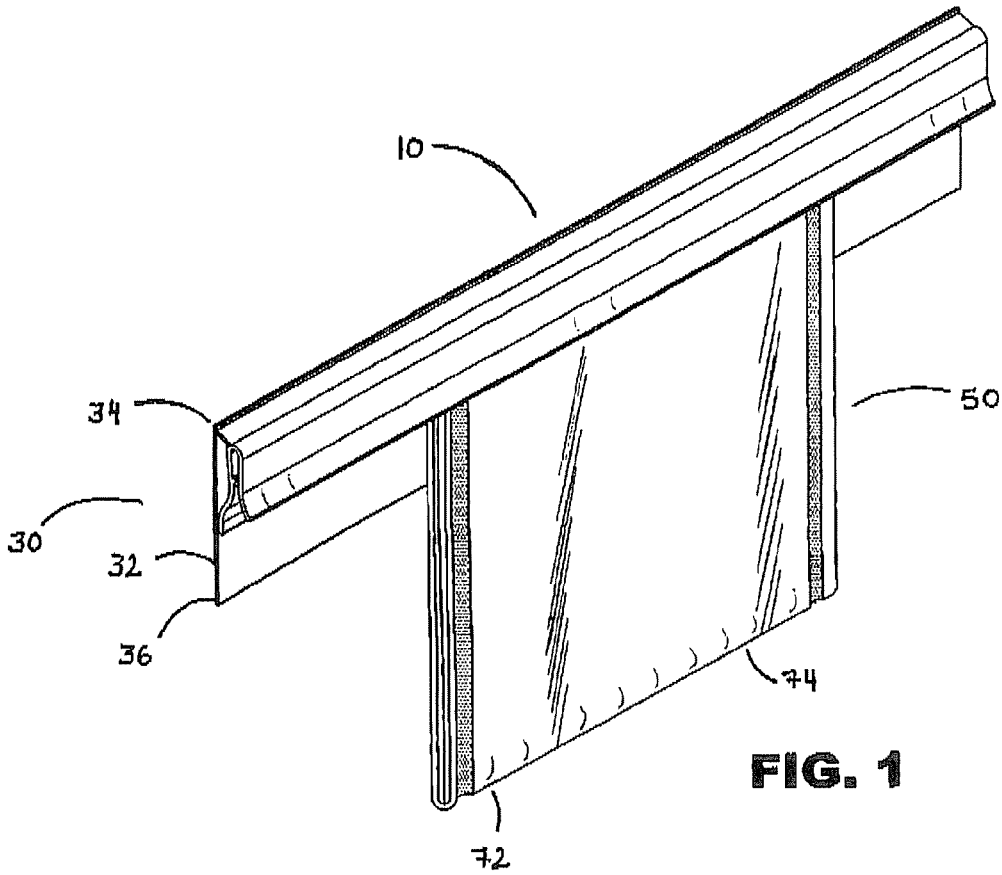
FIG. 1 is a perspective view of a first embodiment of a fluid resistant information display system which incorporates the features of the present invention therein.

In accordance with one aspect of the present invention, a new and improved fluid resistant information system such as a sign pocket or pouch that locks into a sign holder clip with a hingeable mechanism is provided for use in applications where removable and replaceable information labels must be protected against fluids and other environmental and chemical contaminants. More particularly, in accordance with this aspect of the invention, the two-part fluid resistant information system is provided with a first part information pocket that cooperates sealingly with a second part fluid deflecting, downwardly oriented clip portion that is joined flexibly to a mounting portion that mounts to a merchandising display shelf or to any other horizontal, oblique or vertical surfaces, using various fastener means of the invention.

In accordance with another aspect of the present invention, the clip portion of the support assembly of the water resistant information display system comprises two projections or bulges in its constricted portion. This feature allows displaying the partially impermeable information pocket of the invention on any of its two translucent or transparent faces.

One advantage of the present invention is the provision of an information display system which prevents liquids, dust, environmental and chemical contaminants from infiltrating and settling in a display pocket thereof.

A further advantage of the present invention is the provision of an information display system that is easy to install, easy and quick to use and inexpensively produced using conventional extrusion and heat sealing processes.

Yet another advantage of the present invention is the provision of a translucent or transparent information display system where the information pocket can be turned and displayed on any of its two faces.

Another advantage of the present invention is the provision of a generally planar information display system that can be of any size, such as for promotional signage like oversize sale labels and bib tags, or on large bill boards and exhibit displays.

Another advantage of the present invention is the provision of an information display system that has a support assembly that is hingeable allowing for the information pocket inserted into it, to swing inwardly or outwardly, providing free access to merchandise being displayed.

Another advantage of the present invention is the provision of an information display system usable in applications where outside elements or people must be protected against elements inside the information pocket, such as for collection of samples from fluids such as contaminated water, body fluids, dirt, oil and other environmental contaminants requiring immediate viewing or scanning.

Another further advantage of the present invention is the provision of an information display system usable in applications where frequent insertion, collection, sealing and reinsertion of new elements into the pocket are necessary.

Still another advantage of the present invention is the provision of a mounting planar panel on the clip assembly of the invention to be mountable to any structure using any of or a combination of fasteners such as adhesive means, magnetic means, mechanical means, chemical means, hook and loop means.

A yet further advantage of the present invention is the provision of a two-part information display system that has a support assembly part and an information pouch or pocket part. The mounting portion can be mounted and secured to a conventional merchandising fixture.

An additional advantage of the present invention is the provision of a water resistant information display system including a support assembly and an information pocket that can be selectively mounted to a conventional label holder.

Still further advantages of the present invention will become apparent to those of ordinary skill in the art upon reading and understanding the following detailed description of the preferred embodiments.

DETAILED DESCRIPTION OF THE PREFERRED EMBODIMENTS

Figure 2:
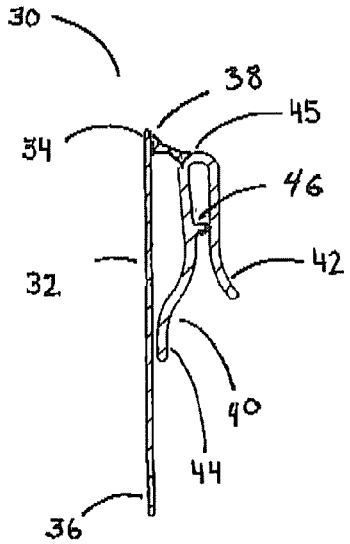
FIG. 2 is an enlarged side elevational view of the support assembly of the two-part fluid resistant information display system of FIG. 1; showing more particularly a clip portion having a single projection such as a bulge in the constricted portion of the clip.
Figure 3:
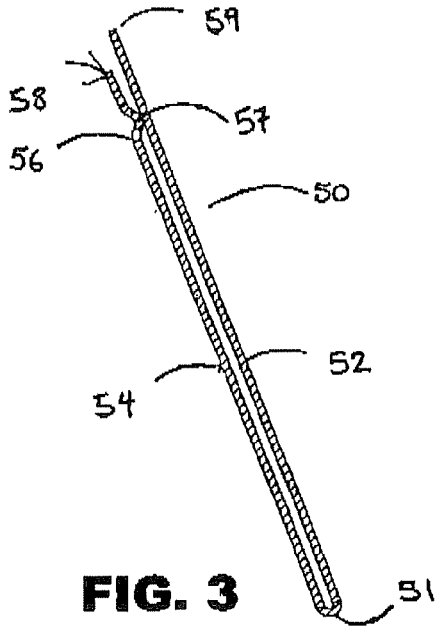
FIG. 3 is an enlarged side elevational view of the information pocket of the fluid resistant information display system of FIG. 1.
Figure 4:
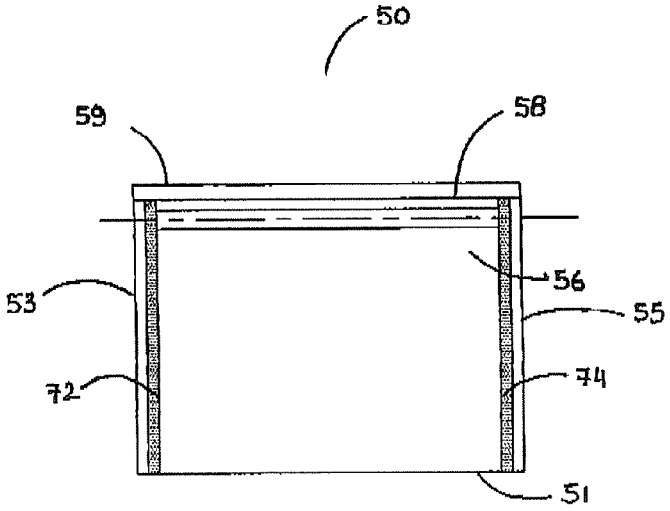
FIG. 4 is a front elevational view of the information pocket of the fluid resistant information display system of FIG. 1.
Figure 5:
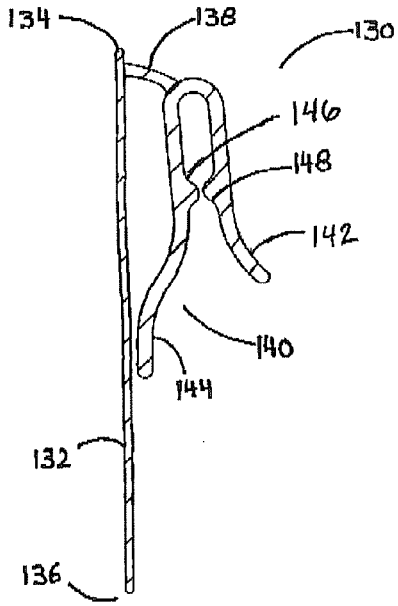
FIG. 5 is an enlarged side elevational view of a second embodiment of the support assembly of a fluid resistant information display system which incorporates the features of the present invention therein, showing more particularly a clip portion with two opposing projections in the constricted portion of the clip.
Figure 8:
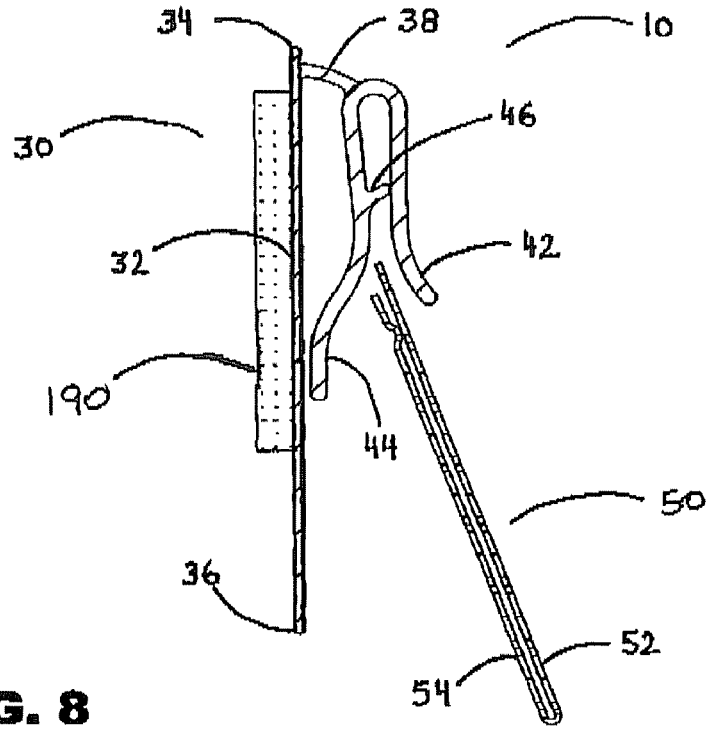
FIG. 8 is an enlarged side elevational view of the fluid resistant information display system of FIG. 1 with and adhesive layer the back mounting panel.

Referring now to the drawings, wherein the showings are for purposes of illustrating several embodiments of the invention only and not for the purposes of limiting same, FIG. 1 shows the two-part fluid resistant information display system 10 according to the first embodiment of the present invention, said system comprised of a first part support assembly 30 shown in FIG. 2 and of a second part the information pocket 50 shown in FIG. 3. The support assembly 30 of the fluid resistant information display system 10 comprises a mounting portion 32 and a downwardly oriented clip portion 40 connected together by a hingeable flexible panel 38. The mounting portion vertical wall 32 has upper and lower end edges 34 and 36, respectively. The hingeable flexible panel 38 is best made of flexible PVC and forms a connecting wall that extends transversely from any location from the vertical wall 32, but preferably from near the upper end edge 34 to the upper portion of said clip portion 45. The clip portion 40 comprises a front panel 42 and a back panel 44 and formed to jointly create a constricted portion, said portion including a projection 46 in a first embodiment of the invention and two opposing projections 46 and 48 in a second embodiment of the invention as shown in FIG. 5;

The information pocket 50 of the fluid resistant information display system 10 comprises of a front panel 52 having an opening edge 59, a rear panel 54 with an opening edge 58, a narrow bottom 51, and a protuberance near and parallel to the pocket opening, said protuberance creates on one side of the rear panel 54 a recessed channel 56 and on other side of rear panel 54 a protruded channel 57. The information pocket two sides 53 and 55 are sealed with respective seals 72 and 74 so as to create the partially impermeable information pocket 50. For ease of opening of the information pocket 50, the front pocket opening edge 59 is slightly higher than the rear pocket opening edge 58 as shown in FIGS. 3, 4 and 8. The protruded channel 57 provides additional rigidity to the back panel edge 58.

To provide a firm, water resistant seal, the information pocket 50 must be inserted into the downwardly oriented clip portion 40 of the clip assembly 30 and be kept firmly in that position during use. The downward gravity assisted position of the clip 40 provides additional water resistance by diverting fluids away from the opening of the information pocket 50.

A fully secured sealing effect occurs when the recessed channel 56 of the information pocket 50 is fully inserted in and locks in position with the clip projection 46, 146 or 148 of the clip assembly 40 or 140. Overcoming the tension needed to open the close gap present in-between the projection 46 on the rear clip panel 44 and the clip front panel 42 on the clip 40 thermoplastic material, provides the tension needed to keep a constant force on the pocket protruded channel 57 of the back panel 54 against the flat surface of the front panel 56 and seal the two parallel pocket panels 52 and 54 so as to provide positive water resistance to the information display system 10 during use.

Figure 6:
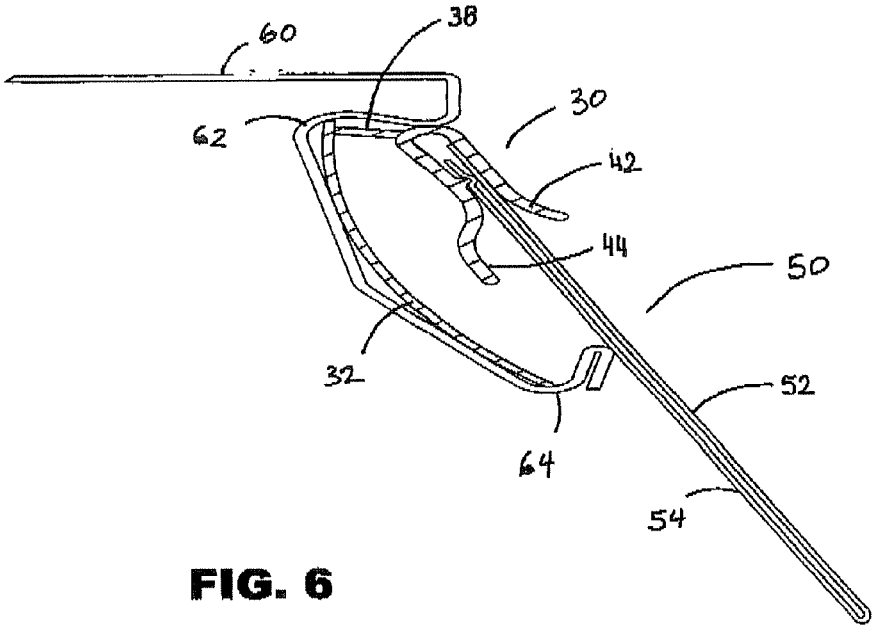
FIG. 6 is a side elevational view of the fluid resistant information display system support assembly of FIG. 1 mounted to a merchandising shelf.

Referring now to FIG. 6, the support assembly 30 of the fluid resistant display system 10 is provided with a mounting planar panel 32 mountable to a merchandising shelf 60 having engaging lips 62 and 64 such as in a C-channel.

Figure 11:
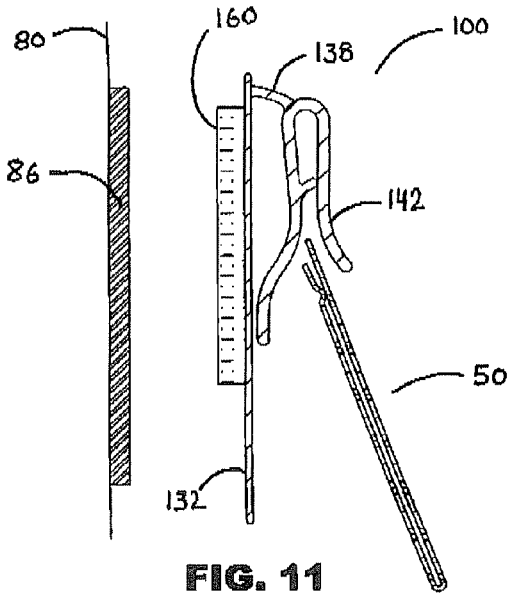
FIG. 11 is a perspective view of another embodiment of the information display system which incorporates the features of the present invention therein; showing more particularly a magnetic layer attached to the back of the mounting planar panel of the support assembly attachable to a metallic surface.
Figure 12:
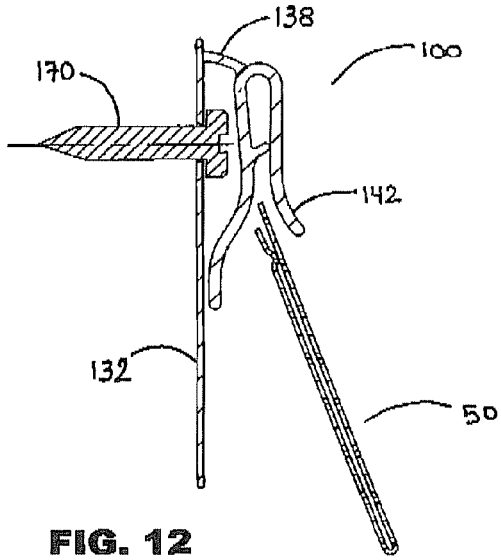
FIG. 12 is a perspective view of yet another embodiment of the information display system which incorporates the features of the present invention therein; showing more particularly a mechanical means for attaching the back of the mounting planar panel of the support assembly.

In another embodiment of the invention, as shown in FIGS. 7, 8, 11, 12 and 13, the support assembly 30 or 130 of the fluid resistant information display system 10 or 100 is provided with a mounting planar panel 32 or 132 that further comprises fastener means selected from the group of fasteners consisting of an adhesive layer 150, a magnetic layer 160 as shown in FIG. 11 attachable to metallic surfaces 86, a mechanical fastener means for attachment by means of a hook, a nail 170 as shown in FIG. 12, a staple, a rivet, a loop, a bolt, a weld, a pin, a peg, a tack, a spike or a chemical fastener 190 as shown in FIG. 8 such as glue, paste, gum, cement, epoxy resin, bonding agent of the like.

Figure 13:
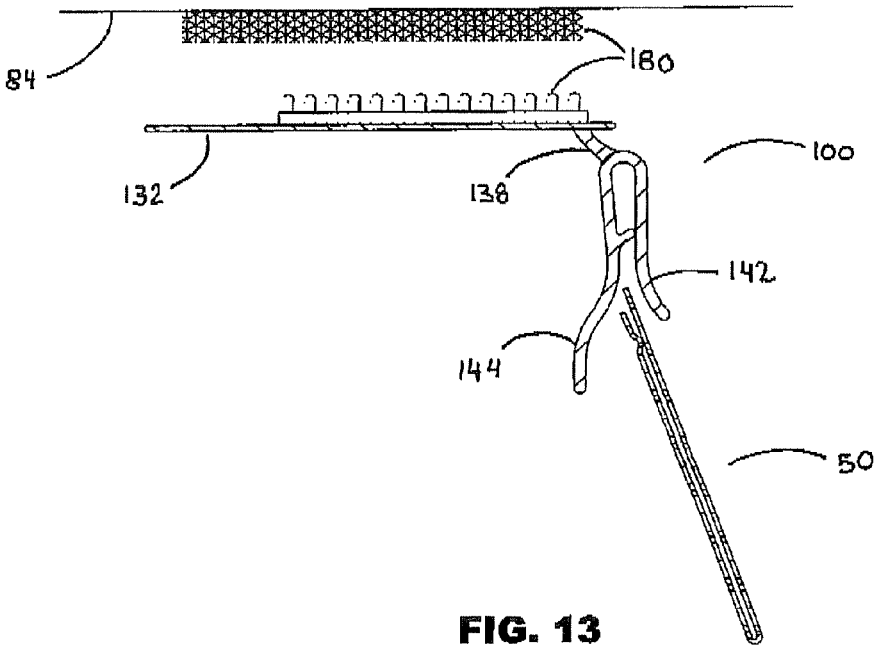
FIG. 13 is a perspective view of a another embodiment of the information display system which incorporates the features of the present invention therein; showing more particularly a hook and loop means attached to the back of the mounting planar panel of the support assembly, for attachment to a horizontal surface.

Using various fastener means allows the information display system to be secured to surfaces having different vertical 80 and horizontal 84 orientations such as shown in FIGS. 11 and 13.

In yet another embodiment of the invention as shown in FIG. 13 the support assembly 130 of the fluid resistant information display system 100 is provided with a mounting planar panel 132 that further comprises a hook and loop fastener means 180.

The fasteners 150, 160, 170 and 180 may be positioned or incorporated as part of the mounting support panel 32 or 132 on its front as shown in FIG. 12 or on its back surface as shown in FIGS. 7, 8, 11, 12 and 13 for attachment to any vertical surface 80, to an oblique (not shown) or a horizontal 84 surface.

The configuration of the information pocket 50 of the fluid resistant information display system 10 and 100 remain identical in all embodiments of the invention.

Figure 9:
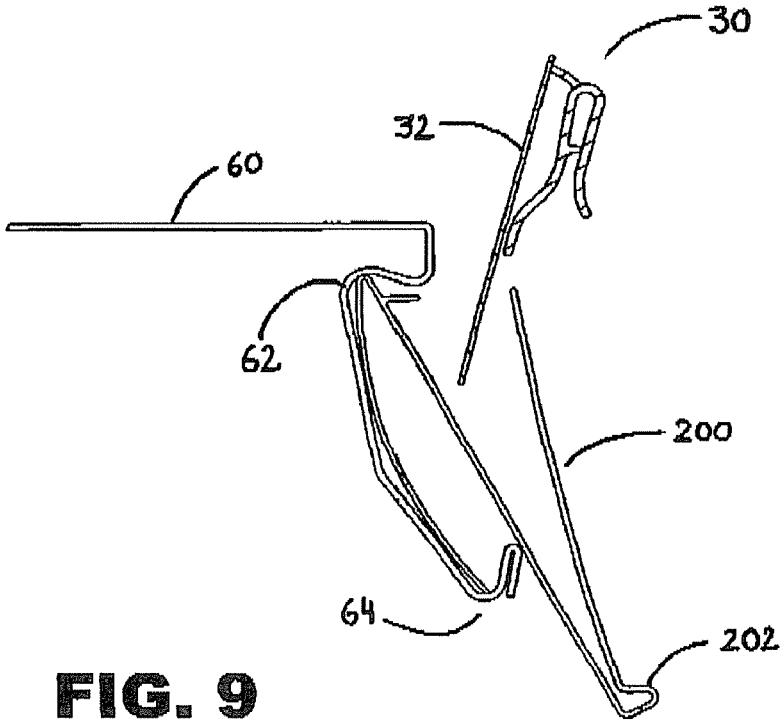
FIG. 9 is a side elevational view of the support assembly of FIG. 2 being partially inserted into the front window of a conventional label holder, said label holder mounted to a shelf.
Figure 10:
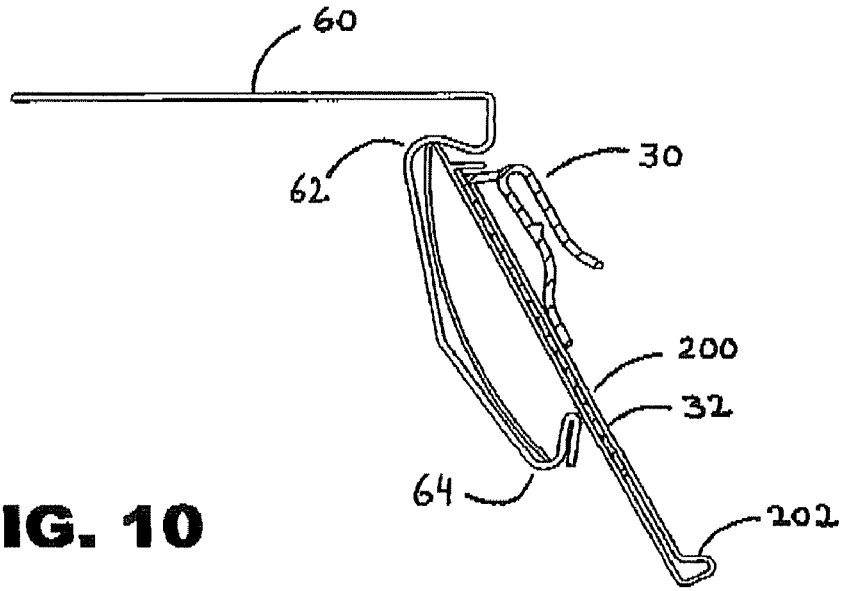
FIG. 10 is a side elevational view of the support assembly of FIG. 2 inserted into the front window of a conventional label holder, said label holder mounted to a shelf.

As shown in FIGS. 9 and 10 the mounting planar panel 30 is mountable into a conventional label pocket having a boot 202 of a information display arrangement 200 mounted on a merchandising shelf 60 including shelf lips 62 and 64.

All components of the system 10 and 100 such as support assembly 30 and 130 and information pocket 50 and 150, are best formed of relatively rigid but flexible plastic material such as rigid PVC, except for the hinging panel 38 and 138 made of flexible PVC. For exposure to chemical contaminants, the selected materials may vary according.

Figure 7:
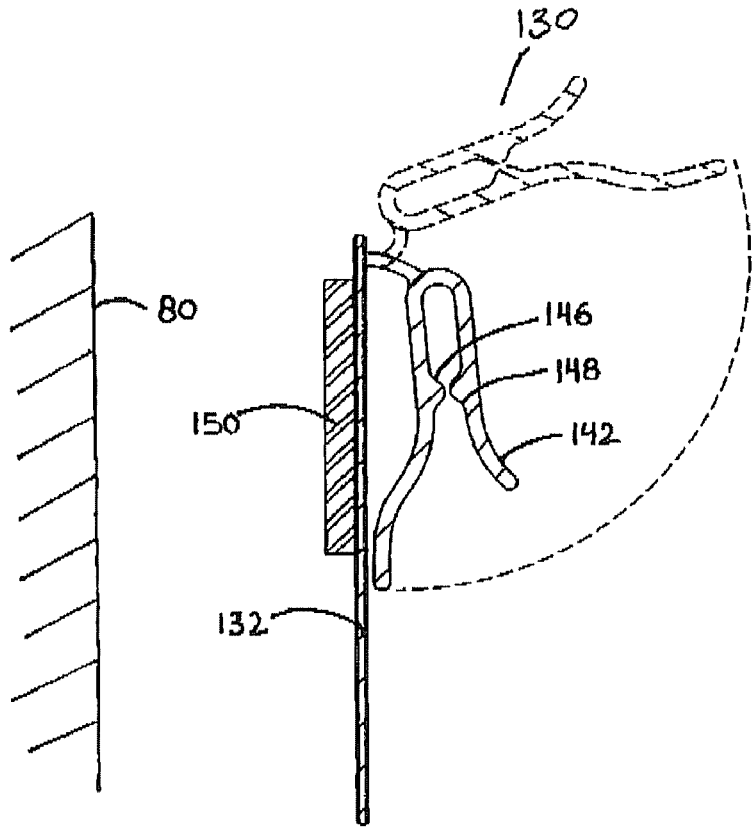
FIG. 7 is a perspective view of a third embodiment of the fluid resistant information display system which incorporates the features of the present invention therein, showing more particularly a chemical fastener such as an adhesive layer attached to the back of the mounting planar panel of the support assembly. As in all embodiments of the invention, the clip portion can swing.

In embodiments of the invention wherein the constricted portion of said clip 30 includes the two projections 46 and 48 such as in FIGS. 5 and 7, the information pocket 50 may be inserted into said clip 140 regardless of the side in which the recessed channel 56 is positioned on the information pocket 50. In said embodiments wherein the information pocket 50 is translucent or transparent, the pocket may be easily turned, sealed and immediately displayed again.

Because of the hingeable and flexible property of the panel 38 and 138 that connects the mounting planar panel 32 and 132 to the clip 40 and 140, the fluid resistant information display system 10 and 100 may swing inwardly or outwardly as shown in FIGS. 7, 12 and 13.

The present invention provides an inexpensively manufactured, easily and quickly installed, user-friendly, easily changeable, replaceable and face selectable fluid resistant information display system, namely for promotional signage like oversize sale labels, bib tags that hang below the scan strip for added merchandising impact and multiple other applications.

Additionally, the information display system of the invention remains protected against fluids projected from any and all directions at one time. Such conditions prevail during regular water spraying of fruits and vegetables in a merchandising display or when labels are exposed to a moist environment where saturation and bleeding occurs by washdown solutions.

Furthermore, the information display system of the invention may be used, in addition to merchandising, in applications where information pockets are necessary to display important information that must resist outside contamination from air, gases, dirt, dust, oil, grease or similar conditions often present in factories, chemical and pharmaceutical industries or prevailing in outdoor harsh conditions, in which case appropriate materials may be used for their manufacturing.

Yet, the information display system of the invention may also be used in applications where information pockets are used to protect elements inside the pocket, such as for collection and immediate display of samples of fluids such as water, body fluids, dirt, oil and other environmental contaminants requiring immediate viewing or special scanning, and specially where frequent insertion, collection, sealing and reinsertion of new elements into the pocket are necessary.

The information pocket 50 is adapted to receive any size planar merchandising label (not shown) such as conventional 5 inch by 3 inch labels, or for other elements that can be inserted into the information pocket 50, as long as the sizes and shapes of such elements are generally flat with no bulky (not shown) structure therein.

Preferably, both the information pocket 50 rear panel 54 and front panel 52 may be formed from a clear thermoplastic material. When different thermoplastic materials are being used, the information pocket 50 may be formed by a known co-extrusion process using different types of polyvinylchloride (PVC).

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A two-part fluid resistant information display system, said system comprising a first part removably mountable information pocket having an opening, said information pocket opening cooperating sealingly with a second part support assembly, said support assembly comprising:

a mounting portion wherein said mounting portion includes a mounting planar panel having an upper edge;

a downwardly oriented clip portion, said clip portion comprising a front panel and a back panel forming jointly a constricted portion, said constricted portion including a projection;

a hingeable flexible panel joining said clip upper portion to said mounting planar panel; said information pocket comprising:

a partially impermeable pocket having an opening defined in between a first and a second pocket panel wherein a protuberance created alongside and parallel to the opening edge of the first pocket panel forms on one side of said first pocket panel, a recessed channel and on the other side a protruded channel, said protruded channel in contact with said second pocket panel, said partially impermeable pocket being kept fully sealed against fluid infiltration when said recessed channel on said pocket opening is inserted into said clip assembly and positioned so as to lock into said clip projection.

2. The fluid resistant information display system of claim 1 wherein said mounting planar panel is mountable to a merchandising shelf having engaging lips.

3. The fluid resistant information display system of claim 1 wherein said mounting planar panel further comprises an adhesive layer made of a chemical fastener on its front or on its back surface for attachment to a support surface.

4. The fluid resistant information display system of claim 1 wherein said mounting planar panel further comprises a magnetic layer on its front or on its back surface for attachment to a support surface.

5. The fluid resistant information display system of claim 1 wherein said mounting planar panel further comprises a mechanical fastener means support surfaces.

6. The fluid resistant information display system of claim 1 wherein said mounting planar panel is provided with a hook and loop arrangement.

7. The fluid resistant information display system of claim 1 wherein said mounting planar panel mounts into the label pocket of a conventional label display arrangement.

8. The fluid resistant information display system of claim 1 wherein one of the pocket panels near said opening edge is higher than the.

9. The fluid resistant information display system of claim 1 wherein said information display system is formed of a relatively rigid but flexible plastics material.

10. The fluid resistant information display system of claim 1 wherein the downward orientated clip assembly diverts fluids away from the information pocket.

11. The fluid resistant information display system of claim 1 wherein the clip hingeable flexible panel allows an inward or outward swing of the information pocket providing easy access to merchandise displayed behind said information pocket.

12. A two-part fluid resistant information display system, said system comprising a first part removably mountable information pocket having an opening, said information pocket opening cooperating sealingly with a second part support assembly, said support assembly comprising:

a mounting portion wherein said mounting portion includes a mounting planar panel having an upper edge;

a downwardly oriented clip portion, said clip portion comprising a front panel and a back panel forming jointly a constricted portion, said constricted portion including two opposing projections;

a hingeable flexible panel joining said clip upper portion to said mounting planar panel;

said information pocket comprising:

a partially impermeable pocket having an opening defined between a first and a second pocket panel wherein a protuberance created alongside the opening edge of the first pocket panel forms on one side of said first pocket panel, a recessed channel and on the other side a protruded channel, said protruded channel being in close contact with said second pocket panel, said partially impermeable pocket being fully sealed against fluid infiltration when said recessed channel on said pocket opening is inserted into said clip assembly and positioned so as to lock into one of said two opposing clip projections.

13. The fluid resistant information display system of claim 12 wherein the information pocket is made of a translucent or transparent material and wherein said information pocket may be easily inserted, repositioned, modified, replaced, turned and repositioned on any of two sides and sealed against fluid infiltration as soon as it is reinserted into said clip portion.

14. The fluid resistant information display system of claim 12 wherein the clip hingeable flexible panel allows an inward or outward swing of the information pocket providing easy access to merchandise displayed behind said information pocket.

* * * * *